US007112126B1

(12) United States Patent
Wang

(10) Patent No.: US 7,112,126 B1
(45) Date of Patent: Sep. 26, 2006

(54) BELT SANDER FOR DELIVERING WORKPIECE AT A CONSTANT SPEED

(76) Inventor: Wang Tien Wang, No. 45, Yi Chang East Rd., Taiping City, Taichung County (TW) 411

( * ) Notice: Subject to any disclaimer, the term of this patent is extended or adjusted under 35 U.S.C. 154(b) by 0 days.

(21) Appl. No.: 11/111,545

(22) Filed: Apr. 20, 2005

(51) Int. Cl.
*B24B 21/00* (2006.01)

(52) U.S. Cl. ..... 451/301; 451/489

(58) Field of Classification Search ..... 451/301, 451/300, 489, 296
See application file for complete search history.

(56) References Cited

U.S. PATENT DOCUMENTS 207,717 A * 9/1878 Creager ..... 451/188
592,992 A * 11/1897 Lowry et al. ..... 451/301
6,146,254 A * 11/2000 Wang ..... 451/65

FOREIGN PATENT DOCUMENTS

SU 611762 * 6/1978 ..... 451/65

* cited by examiner

*Primary Examiner*—Robert A. Rose
(74) *Attorney, Agent, or Firm*—Bacon & Thomas, PLLC

(57) ABSTRACT

A belt sander includes a sand belt unit including an upper roller, a lower roller located under the upper roller and rotated by a propeller shaft of a drive motor, and two auxiliary rollers located at two sides of the lower roller. Each of the two auxiliary rollers and the lower roller are rotated synchronously in the opposite direction. Thus, the workpiece is pressed by the two auxiliary rollers so that the workpiece is moved forward at a constant speed without acceleration during the grinding process of the sand belt, thereby enhancing the grinding effect of the sand belt on the workpiece.

9 Claims, 7 Drawing Sheets

BELT SANDER FOR DELIVERING WORKPIECE AT A CONSTANT SPEED

BACKGROUND OF THE INVENTION

1. Field of the Invention

The present invention relates to a belt sander, and more particularly to a belt sander for delivering a workpiece at a constant speed.

2. Description of the Related Art

A conventional belt sander comprises a frame, an upper roller mounted on an upper end of the frame, a lower roller mounted on a lower end of the frame, and a sand belt mounted between the upper roller and the lower roller. Thus, the sand belt is driven by the upper roller and the lower roller to rotate at a high speed to grind a workpiece, such as a wooden material.

In practice, when the workpiece touches the sand belt, the workpiece is accelerated by the pulling force of the sand belt. When the workpiece is grinded by the sand belt, the workpiece is moved forward smoothly by friction and resistance of the sand belt. When the workpiece is about to leave the sand belt, the resistance applied on the workpiece by the sand belt is removed, so that the workpiece is accelerated to move forward. However, the workpiece is not moved forward at a constant during the grinding process, thereby greatly decreasing the grinding effect and the quality of the workpiece.

SUMMARY OF THE INVENTION

The present invention is to mitigate and/or obviate the disadvantage of the conventional belt sander.

The primary objective of the present invention is to provide a belt sander for delivering a workpiece at a constant speed so that the workpiece enters and leaves the belt sander smoothly, thereby enhancing the working efficiency and the grinding quality of the belt sander.

Another objective of the present invention is to provide a belt sander, wherein the workpiece is pressed by the two auxiliary rollers so that the workpiece is moved forward at a constant speed without acceleration during the grinding process of the sand belt, thereby enhancing the grinding effect of the sand belt on the workpiece.

A further objective of the present invention is to provide a belt sander, wherein the auxiliary rollers do not provide a grinding action, so that the auxiliary rollers will not break the surface of the workpiece.

In accordance with the present invention, there is provided a belt sander, comprising:

a sand belt unit including an upper roller, a lower roller located under the upper roller and rotated by a propeller shaft of a drive motor, and two auxiliary rollers located at two sides of the lower roller; wherein each of the two auxiliary rollers and the lower roller are rotated synchronously in the opposite direction.

Further benefits and advantages of the present invention will become apparent after a careful reading of the detailed description with appropriate reference to the accompanying drawings.

DETAILED DESCRIPTION OF THE INVENTION

Figure 1:
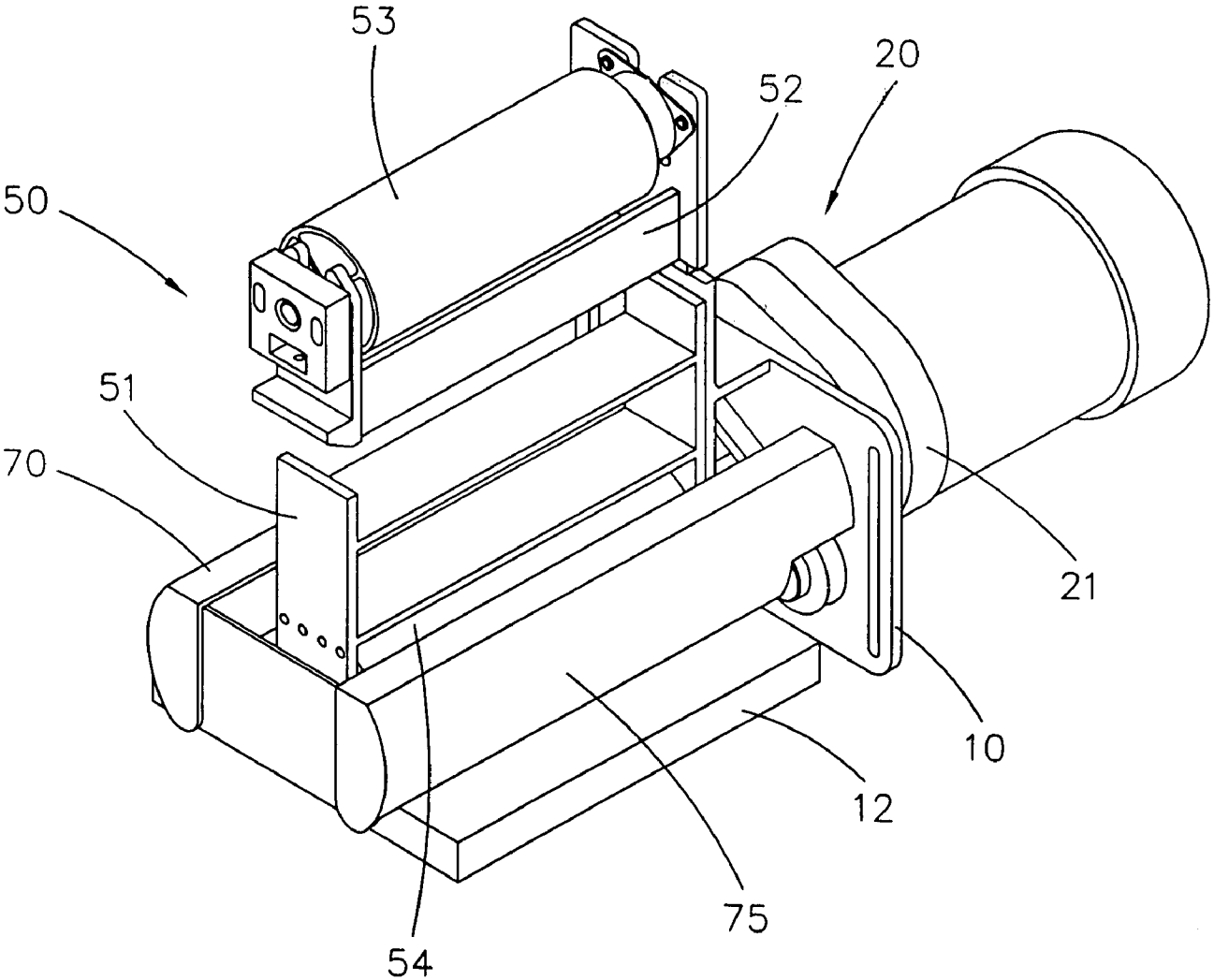
FIG. 1 is a perspective view of a belt sander in accordance with the preferred embodiment of the present invention.
Figure 2:
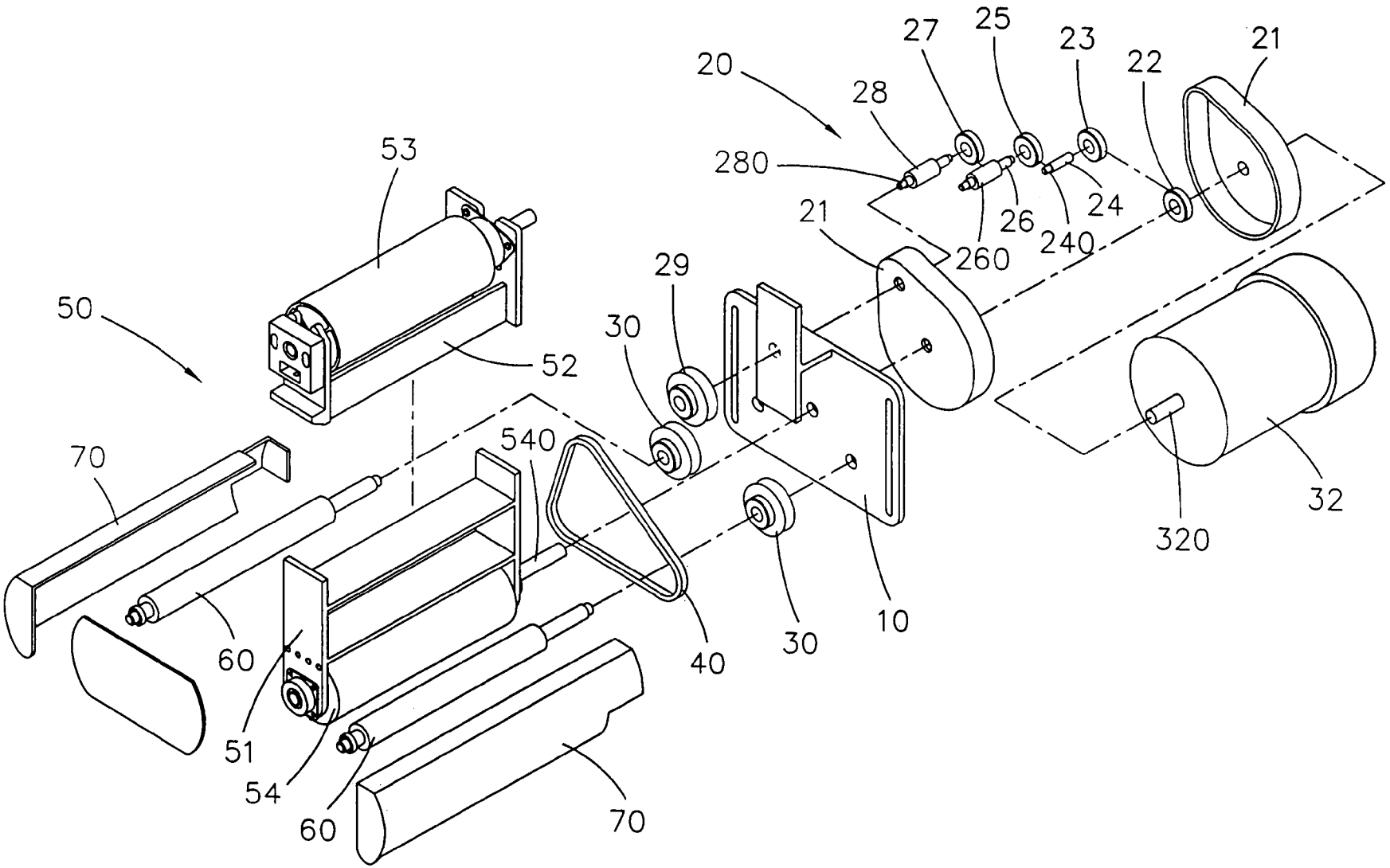
FIG. 2 is an exploded perspective view of the belt sander as shown in FIG. 1.
Figure 3:
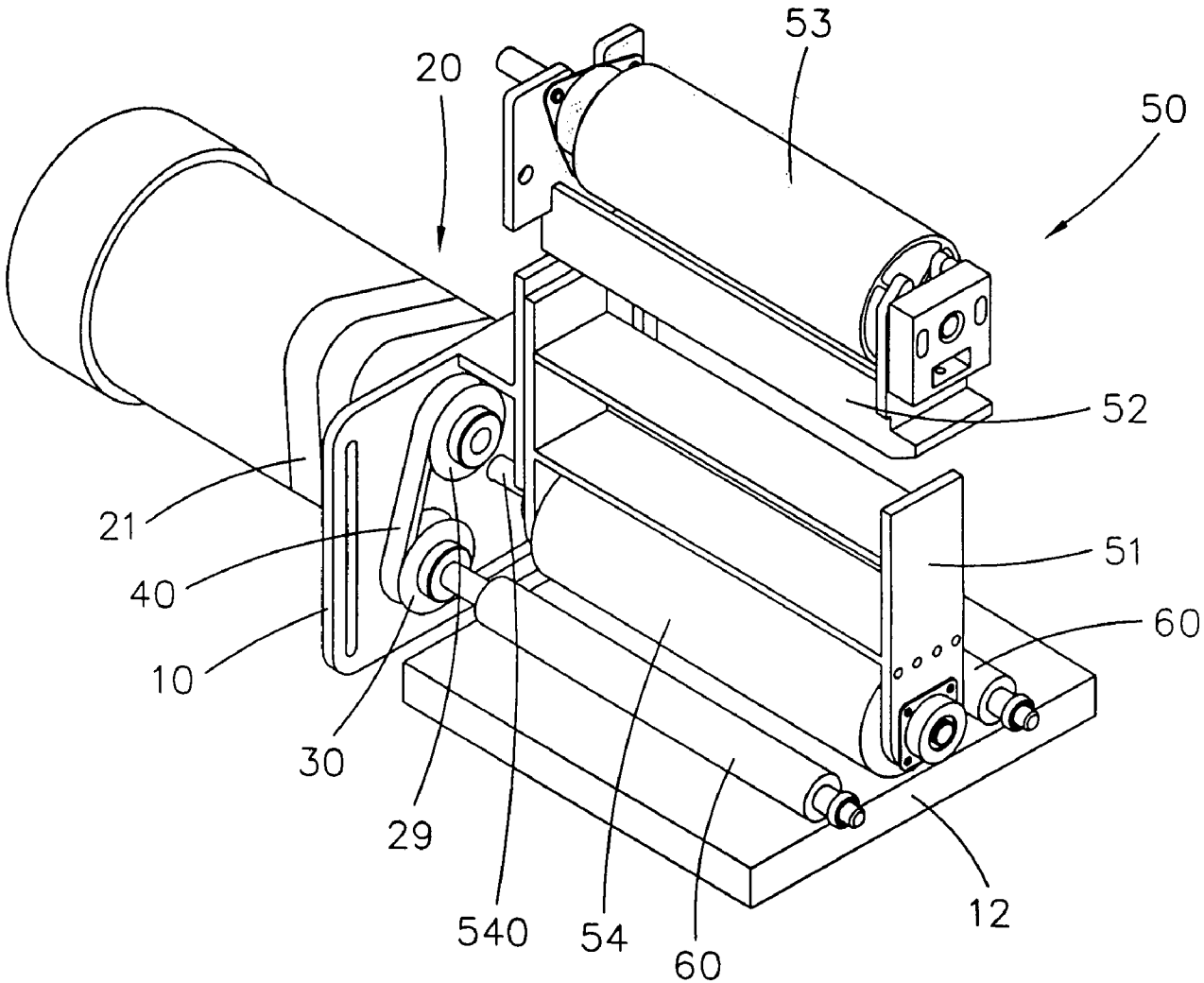
FIG. 3 is a perspective view of the belt sander as shown in FIG. 1.
Figure 5:
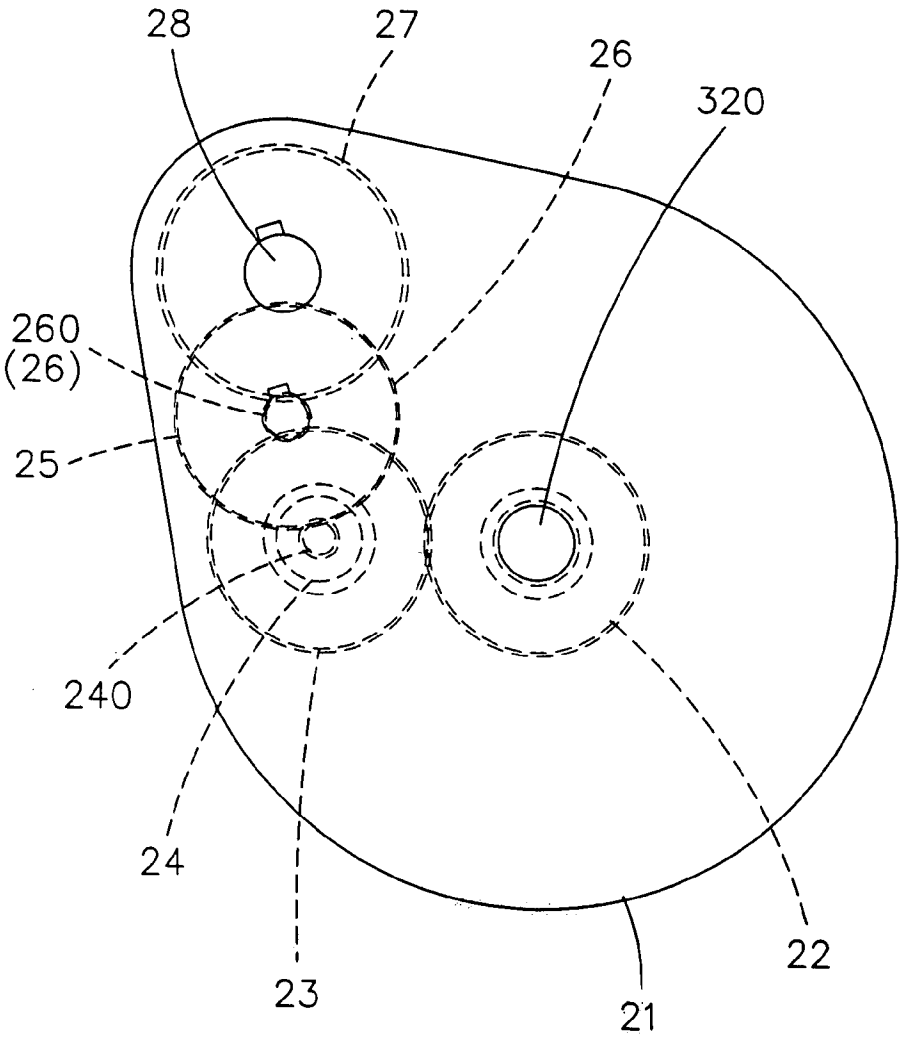
FIG. 5 is a plan of the belt sander as shown in FIG. 1.
Figure 4:
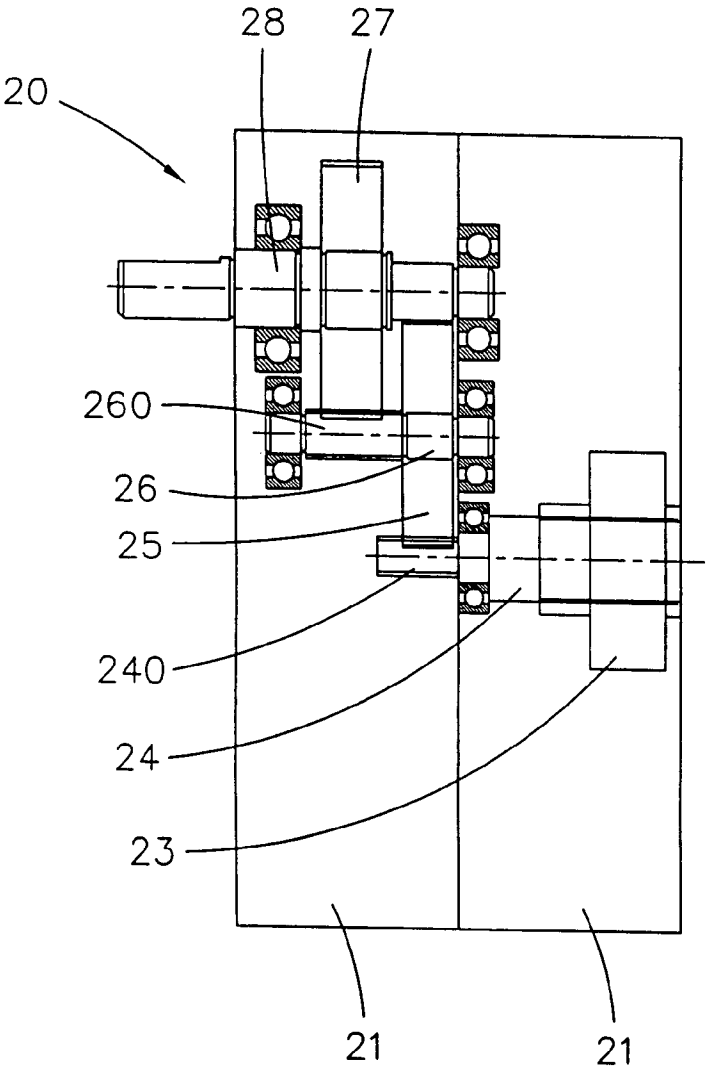
FIG. 4 is a plan cross-sectional of the belt sander as shown in FIG. 1.

Referring to the drawings and initially to FIGS. 1–6, a belt sander in accordance with the preferred embodiment of the present invention comprises a worktable 12, a support plate 10 mounted on the worktable 12, a sand belt unit 50 mounted on a first side of the support plate 10, and a driving unit 20 mounted on a second side of the support plate 10.

The sand belt unit 50 is driven by a drive motor 32 which is mounted on the support plate 10. The sand belt unit 50 includes an upper roller 53, a lower roller 54 located under the upper roller 53 and rotated by a propeller shaft 320 of the drive motor 32, and two auxiliary rollers 60 located at two sides of the lower roller 54.

The lower roller 54 has a shaft 540 extended through the support plate 10 and connected to the propeller shaft 320 of the drive motor 32 so that the lower roller 54 is directly rotated by the propeller shaft 320 of the drive motor 32 to rotate with the propeller shaft 320 of the drive motor 32 synchronously in the same direction.

Figure 6:
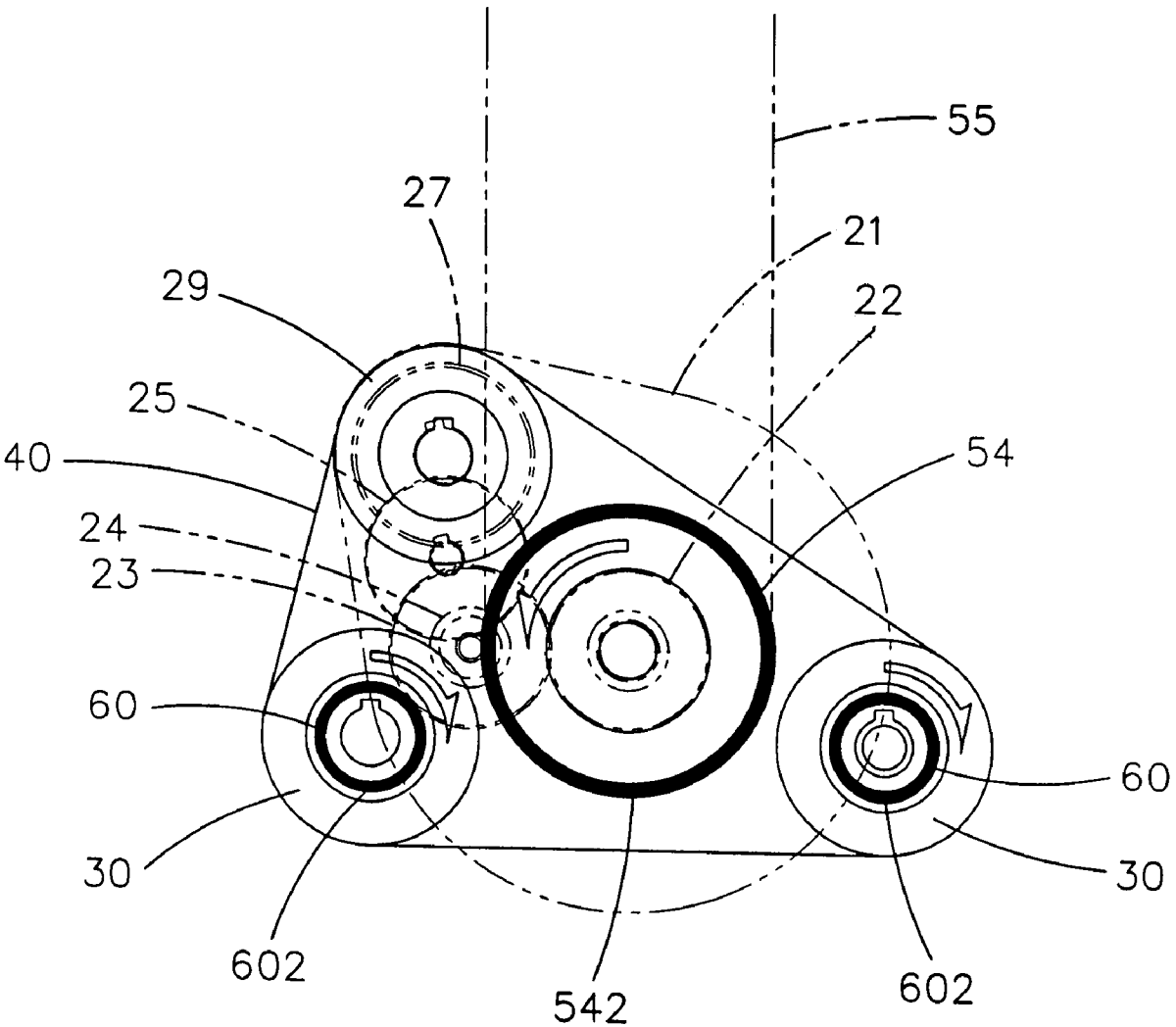
FIG. 6 is a plan cross-sectional of the belt sander as shown in FIG. 1.

Each of the two auxiliary rollers 60 and the lower roller 54 are rotated synchronously in the opposite direction. In addition, each of the two auxiliary rollers 60 has a bottom edge 602 having a height equal to that of a bottom edge 542 of the lower roller 54 as shown in FIG. 6.

The sand belt unit 50 further includes a sand belt 55 (see FIG. 6) mounted between the upper roller 53 and the lower roller 54 and rotated by the lower roller 54 so that the upper roller 53 is rotated in concert with the lower roller 54. Thus, the sand belt 55 is rotated on the upper roller 53 and the lower roller 54 to rotate at a high speed to grind a workpiece (such as a wooden material) 80 (see FIG. 7) placed on the worktable 12.

The sand belt unit 50 further includes a frame 51 mounted on the support plate 10 to support the lower roller 54, a support seat 52 located adjacent to and movable relative to the frame 51 to support the upper roller 53. Thus, the upper roller 53 is movable relative to the lower roller 54 by movement of the support seat 52 relative to the frame 51 to adjust the distance between the upper roller 53 and the lower roller 54 so as to adjust the tension of the sand belt 55.

The sand belt unit 50 further includes two protective hoods 70 mounted on the frame 51 to encompass the two auxiliary rollers 60 so as to limit the thickness of the workpiece 80 entering the auxiliary roller 60, thereby preventing the workpiece 80 from directly hitting the auxiliary roller 60 so as to protect the auxiliary roller 60. In addition, the protective hoods 70 also provide a dustproof effect.

The sand belt unit 50 further includes a propeller wheel 29 rotated with the propeller shaft 320 of the drive motor 32 synchronously in the opposite direction, two driven wheels 30 (having the same height) each secured on a distal end of a respective of the two auxiliary rollers 60 for rotating the respective auxiliary roller 60, and a belt 60 mounted between the propeller wheel 29 and the two driven wheels 30 so that each of the two driven wheels 30 is rotated with the propeller wheel 29 synchronously in the same direction, and each of the two auxiliary rollers 60 is rotated with the propeller shaft 320 of the drive motor 32 synchronously in the opposite direction.

Thus, the lower roller 54 is rotated with the propeller shaft 320 of the drive motor 32 synchronously in the same direction, and each of the two auxiliary rollers 60 is rotated with the propeller shaft 320 of the drive motor 32 synchronously in the opposite direction, so that each of the two auxiliary rollers 60 and the lower roller 54 are rotated synchronously in the opposite direction.

The driving unit 20 is driven by the drive motor 32 and includes a detachable housing 21 mounted on the support plate 10 to allow passage of the propeller shaft 320 of the drive motor 32, a first drive wheel 22 secured on the propeller shaft 320 of the drive motor 32 to rotate therewith, a first 11 drive shaft 24 rotatably mounted in the housing 21 and having a first end provided with a second drive wheel 23 engaged with and rotated by the first drive wheel 22 and a second end formed with a first engaging wheel 240, a second drive shaft 26 rotatably mounted in the housing 21 and having a first end provided with a third drive wheel 25 engaged with and rotated by the first engaging wheel 240 of the first drive shaft 24 and a second end formed with a second engaging wheel 260, and a third drive shaft 28 rotatably mounted in the housing 21 and having a first end provided with a fourth drive wheel 27 engaged with and rotated by the second engaging wheel 260 of the second drive shaft 26 and a second end 280 extended through the housing 21 and the support plate 10 and secured to the propeller wheel 29 for rotating the propeller wheel 29. Thus, the propeller wheel 29 is rotated with the propeller shaft 320 of the drive motor 32 synchronously in the opposite direction.

As shown in FIG. 6, each of the two auxiliary rollers 60 and the lower roller 54 are rotated synchronously in the opposite direction so that the sand belt 55 and each of the two auxiliary rollers 60 are rotated synchronously in the opposite direction.

Figure 7:
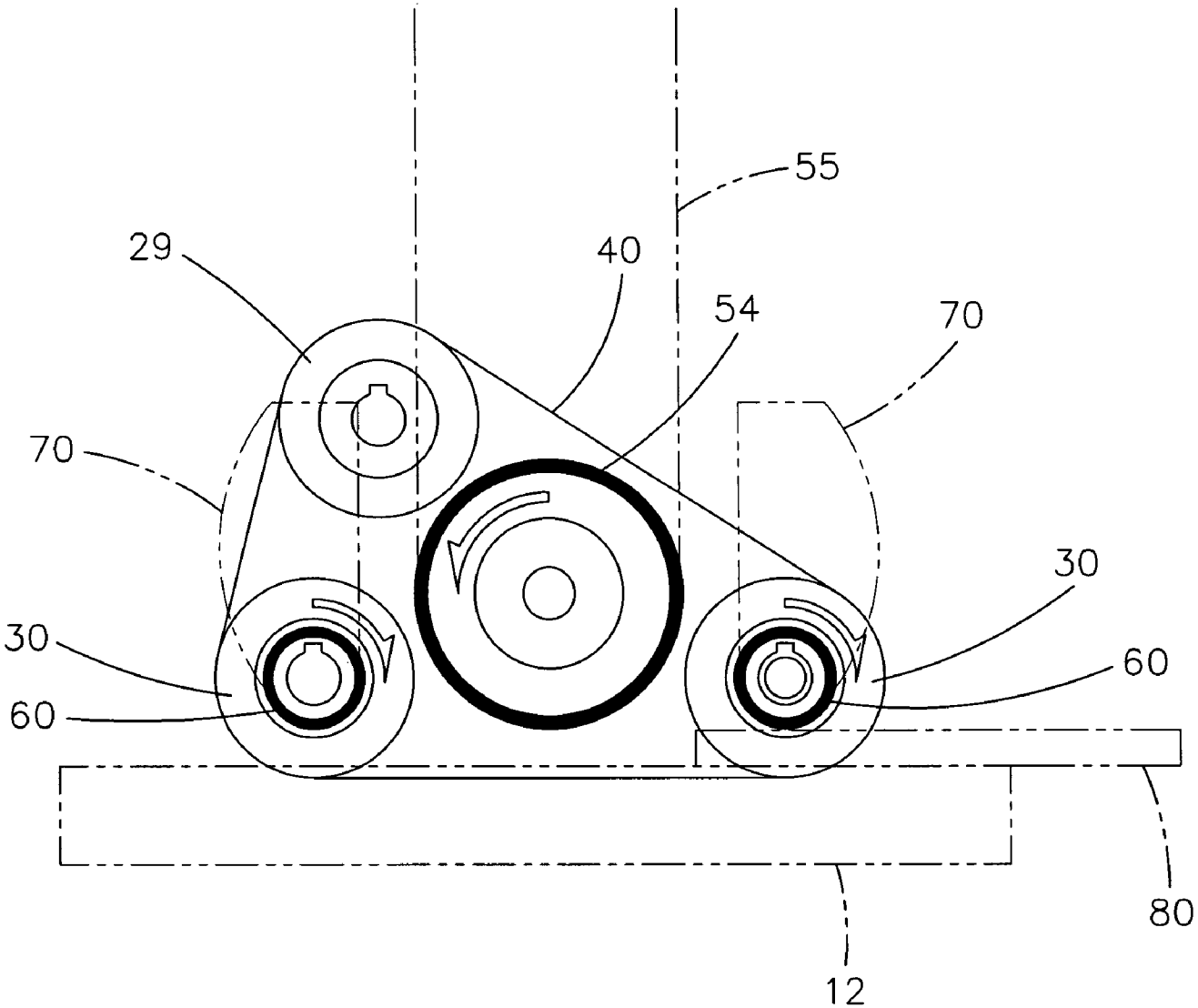
FIG. 7 is a schematic operational view of the belt sander as shown in FIG. 6.

As shown in FIG. 7, when the workpiece 80 enters the first one of the auxiliary rollers 60, the workpiece 80 is pressed by the first one of the auxiliary rollers 60. At this time, the first one of the auxiliary rollers 60 does not provide a grinding action, so that the first one of the auxiliary rollers 60 will not break the surface of the workpiece 80. When the workpiece 80 touches the sand belt 55, the workpiece 80 is pressed by the first one of the auxiliary rollers 60 so that the workpiece 80 is moved forward at a constant speed to facilitate the grinding action of the sand belt 55.

Figure 8:
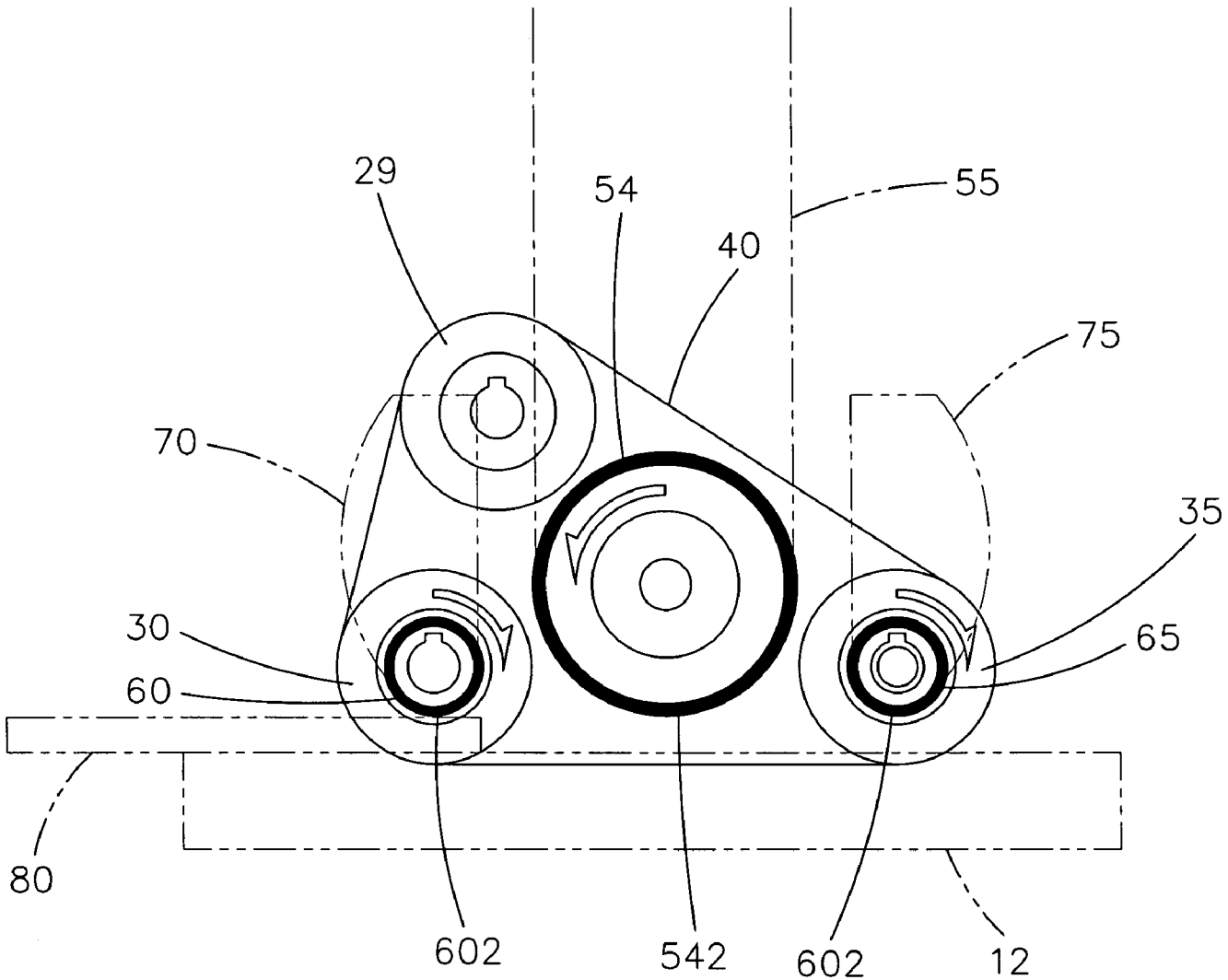
FIG. 8 is a schematic operational view of the belt sander as shown in FIG. 7.

As shown in FIG. 8, when the workpiece 80 leaves the sand belt 55, the workpiece 80 is pressed by the second one of the auxiliary rollers 60 so that the workpiece 80 is also moved forward at a constant speed without producing acceleration. When the workpiece 80 is to leave the second one of the auxiliary rollers 60, the workpiece 80 is accelerated. At this time, the second one of the auxiliary rollers 60 does not provide a grinding action, so that the second one of the auxiliary rollers 60 will not break the surface of the workpiece 80.

Accordingly, the workpiece 80 is pressed by the two auxiliary rollers 60 so that the workpiece 80 is moved forward at a constant speed without producing acceleration during the grinding process of the sand belt 55, thereby enhancing the grinding effect of the sand belt 55 on the workpiece 80. In addition, the auxiliary rollers 60 do not provide a grinding action, so that the auxiliary rollers 60 will not break the surface of the workpiece 80.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A belt sander, comprising:

a sand belt unit including an upper roller, a lower roller located under the upper roller and rotated by a propeller shaft of a drive motor, and two auxiliary rollers located at two sides of the lower roller; wherein each of the two auxiliary rollers and the lower roller are rotated synchronously;

the two auxiliary rollers are rotated in the same direction, that direction being opposite to the direction of rotation of the lower roller:

the lower roller has a shaft extended through a support plate and connected to the propeller shaft of the drive motor so that the lower roller is directly rotated by the propeller shaft of the drive motor to rotate with the propeller shaft of the drive motor synchronously in the same direction.

2. The belt sander in accordance with claim 1, wherein each of the two auxiliary rollers has a bottom edge having a height equal to that of a bottom edge of the lower roller.

3. The belt sander in accordance with claim 1, wherein the sand belt unit further includes a frame to support the lower roller, and two protective hoods mounted on the frame to encompass the two auxiliary rollers.

4. A belt sander, comprising:

a sand belt unit including an upper roller, a lower roller located under the upper roller and rotated by a propeller shaft of a drive motor, and two auxiliary rollers located at two sides of the lower roller; wherein each of the two auxiliary rollers and the lower roller are rotated synchronously;

the two auxiliary rollers are rotated in the same direction, that direction being opposite to the direction of rotation of the lower roller;

the sand belt unit further includes a propeller wheel rotated with the propeller shaft of the drive motor synchronously, two driven wheels each secured on a distal end of a respective one of the two auxiliary rollers for rotating the respective auxiliary roller, and a belt mounted between the propeller wheel and the two driven wheels so that each of the two driven wheels is rotated with the propeller wheel synchronously, and each of the two auxiliary rollers is rotated with the propeller shaft of the drive motor synchronously.

5. The belt sander in accordance with claim 4, wherein the lower roller is rotated with the propeller shaft of the drive motor synchronously, and each of the two auxiliary rollers is rotated with the propeller shaft of the drive motor synchronously, so that each of the two auxiliary rollers and the lower roller are rotated synchronously.

6. The belt sander in accordance with claim 4, further comprising a driving unit driven by the drive motor and including a detachable housing mounted on a support plate to allow passage of the propeller shaft of the drive motor, a first drive wheel secured on the propeller shaft of the drive motor to rotate therewith, a first drive shaft rotatably mounted in the housing and having a first end provided with a second drive wheel engaged with and rotated by the first drive wheel and a second end formed with a first engaging wheel, a second drive shaft rotatably mounted in the housing and having a first end provided with a third drive wheel engaged with and rotated by the first engaging wheel of the first drive shaft and a second end formed with a second engaging wheel, and a third drive shaft rotatably mounted in the housing and having a first end provided with a fourth drive wheel engaged with and rotated by the second engaging wheel of the second drive shaft and a second end extended through the housing and secured to the propeller wheel for rotating the propeller wheel.

7. The belt sander in accordance with claim 1, wherein the sand belt unit further includes a sand belt mounted between the upper roller and the lower roller and rotated by the lower roller so that the upper roller is rotated in concert with the lower roller.

8. The belt sander in accordance with claim 7, wherein the sand belt and each of the two auxiliary rollers are rotated synchronously.

9. A belt sander, comprising:

a sand belt unit including an upper roller, a lower roller located under the upper roller and rotated by a propeller shaft of a drive motor, and two auxiliary rollers located at two sides of the lower roller; wherein each of the two auxiliary rollers and the lower roller are rotated synchronously;

the two auxiliary rollers are rotated in the same direction, that direction being opposite to the direction of rotation of the lower roller;

the sand belt unit further includes a frame to support the lower roller, a support seat located adjacent to and movable relative to the frame to support the upper roller so that the upper roller is movable relative to the lower roller by movement of the support seat relative to the frame to adjust the distance between the upper roller and the lower roller.

* * * * *